US007758487B2

(12) United States Patent
Elsayed et al.

(10) Patent No.: US 7,758,487 B2
(45) **Date of Patent: *Jul. 20, 2010**

(54) TECHNOLOGY FOR CONTINUOUS FOLDING OF SHEET MATERIALS INTO A HONEYCOMB-LIKE CONFIGURATION

(75) Inventors: Elasyed A. Elsayed, East Brunswick, NJ (US); Basily B. Basily, Piscataway, NJ (US)

(73) Assignee: Rutgers, The State University of New Jersey, New Brunswick, NJ (US)

( * ) Notice: Subject to any disclaimer, the term of this patent is extended or adjusted under 35 U.S.C. 154(b) by 346 days.

This patent is subject to a terminal disclaimer.

(21) Appl. No.: 11/518,642

(22) Filed: Sep. 11, 2006

(65) Prior Publication Data

US 2007/0004576 A1 Jan. 4, 2007

Related U.S. Application Data

(63) Continuation-in-part of application No. 11/265,571, filed on Nov. 2, 2005, which is a continuation of application No. 10/755,334, filed on Jan. 13, 2004, now Pat. No. 7,115,089.

(60) Provisional application No. 60/448,896, filed on Feb. 24, 2003, provisional application No. 60/448,884, filed on Feb. 24, 2003.

(51) Int. Cl.
*B31F 1/10* (2006.01)

(52) U.S. Cl. ..... 493/435; 493/442

(58) Field of Classification Search ..... 493/453, 493/356–360, 424, 432, 435, 442, 380, 381; 72/179–182; 156/166, 176, 200, 205, 208, 156/210

See application file for complete search history.

(56) References Cited

U.S. PATENT DOCUMENTS

| | | | | |
|---|---|---|---|---|
| 1,485,917 | A | 3/1924 | Harter | 72/176 |
| 1,766,743 | A | 6/1930 | Freeze | 72/180 |
| RE18,760 | E | 3/1933 | Yoder | 72/180 |
| 2,901,951 | A | 9/1959 | Hochfeld | 493/442 |
| 3,251,211 | A | 5/1966 | Harris | 72/182 |
| 3,988,917 | A | 11/1976 | Mykolenko | 72/187 |
| 4,012,932 | A | 3/1977 | Gewiss | 72/187 |

(Continued)

FOREIGN PATENT DOCUMENTS

| | | |
|---|---|---|
| EP | 0 318 497 B1 | 11/1991 |
| EP | 0 261 140 B1 | 7/1992 |

*Primary Examiner*—Louis K Huynh
(74) *Attorney, Agent, or Firm*—Watov & Kipnes, P.C.; Kenneth Watov

(57) ABSTRACT

A machine and method for the continuous folding of sheet material into different three-dimensional patterns. The innovative machine and method folds sheet material by force converging the sheet to a final stage that imparts a final fold or pattern into the sheet material, the patterns selectively including one of a Chevron pattern, a honeycomb-like pattern, a double-sided inclined folded core structure, and singular inclined direction folded core structure sheet material.

17 Claims, 14 Drawing Sheets

U.S. PATENT DOCUMENTS

| | | | | | |
|---|---|---|---|---|---|
| 4,086,116 | A | * | 4/1978 | Yazaki et al. | 156/210 |
| 4,411,146 | A | | 10/1983 | Sulasaari et al. | 72/180 |
| 4,544,597 | A | * | 10/1985 | Peer et al. | 156/210 |
| 4,871,406 | A | * | 10/1989 | Griffith | 156/210 |
| 5,028,474 | A | | 7/1991 | Czaplicki | 428/178 |
| 5,107,695 | A | | 4/1992 | Vandenbroucke | 72/129 |
| 5,185,052 | A | | 2/1993 | Chappell et al. | 156/462 |
| 5,664,451 | A | | 9/1997 | Schultz | 72/181 |
| 5,947,885 | A | | 9/1999 | Paterson | 493/451 |
| 5,983,692 | A | | 11/1999 | Brück | 72/187 |
| 6,209,375 | B1 | | 4/2001 | Kurose | 72/181 |
| 6,289,707 | B1 | | 9/2001 | Saarenko | 72/177 |
| 6,935,997 | B2 | | 8/2005 | Kling | 493/356 |
| 2002/0094926 | A1 | * | 7/2002 | Kling | 493/356 |

* cited by examiner

TECHNOLOGY FOR CONTINUOUS FOLDING OF SHEET MATERIALS INTO A HONEYCOMB-LIKE CONFIGURATION

RELATED APPLICATIONS

This Application claims priority from U.S. Provisional Application Nos. 60/448,896 and 60/448,884 each filed on Feb. 24, 2003. This application is a Continuation-In-Part from Non-Provisional application Ser. No. 11/265,571 filed on Nov. 2, 2005, the latter being a Continuation from Non-Provisional application Ser. No. 10/755,334 filed on Jan. 13, 2004 now U.S. Pat. No. 7,115,089. The teachings of all the aforesaid related Applications are incorporated herein to the extent they do not conflict herewith.

FIELD OF THE INVENTION

The present invention relates to the folding of sheet materials and, more particularly, to the continuous folding of different types of sheet materials into a multiplicity of predetermined, three-dimensional structural patterns.

BACKGROUND OF THE INVENTION

Folded materials are useful in packaging technology, sandwich structures, floor boards, car bumpers and other applications where requirements pertaining to shock, vibration, energy absorption, and/or a high strength-to-weight ratio including volume reduction must be met.

Continuous folding machines should have versatility, flexibility, and high production rates. Additionally, a machine that can accomplish folding in an inexpensive manner is most rare.

The present inventive machine not only accomplishes the folding of materials in accordance with the aforementioned objectives, but is unique in its ability to fold materials over a wide range of sizes. The machine is also unusual, in that it can handle a wider range of materials.

A machine with the ability to fold different types of sheet materials, as opposed to mere metal, provides a cost saving, because users need invest in only one machine.

A single machine that can fold many different patterns and which can accommodate different materials demonstrates the flexibility of the current invention.

The inventive machine can generate patterns with extensive geometric variations within the same family of patterns. The generated patterns can then be used in many applications such as cores for sandwiched structures, pallets, bridge decks, floor decks, and packaging applications.

In a general overview, the inventive machine causes the material to "funnel" towards an end section, which imparts the final folds or pattern. The funnel process can be thought of as a method that forces, converges, or continuously positions the material towards the final section of the machine, where the material is then finally folded in the desired pattern.

DISCUSSION OF RELATED ART

U.S. Pat. No. 3,988,917, issued to Petro Mykolenko on Nov. 2, 1976 for Apparatus and Method for Making A Chevron Matrix Strip; U.S. Pat. No. 4,012,932, issued to Lucien Gewiss on Mar. 22, 1977 for Machine for Manufacturing Herringbone-Pleated Structures; U.S. Pat. No. 5,028,474, issued to Ronald Czaplicki on Jul. 2, 1991 for Cellular Core Structure Providing Gridlike Bearing Surfaces on Opposing Parallel Planes of the Formed Core; U.S. Pat. No. 5,947,885, issued to James Paterson on Sep. 7, 1999 for Method and Apparatus for Folding Sheet Materials with Tessellated Patterns; and U.S. Pat. No. 5,983,692, issued to Rolf Brück on Nov. 16, 1999 for Process and Apparatus for Producing a Metal Sheet with a Corrugation Configuration and a Microstructure Disposed Transversely with Respect Thereto; and European Patent Publication Nos. 0 318 497 B1, issued to Nils Höglund on Nov. 27, 1991 for Machine for Corrugating Sheet Metal or the Like; and 0 261 140 B1, issued to Nilsen et al. on Jul. 1, 1992 for Machine for Adjustable Longitudinal Corrugating of Sheet Materials, all relate to the art of forming sheet material. However, none of these patents or publications discloses a machine that performs a folding operation using tessellations according to the mathematical series 1, 3, 5, 7, . . . on each roller in a series of rollers or grooves on parallel flat dies or surfaces. Also, the prior art does not teach other embodiments of the invention as described and claimed below.

SUMMARY OF THE INVENTION

In accordance with the present invention, a machine and method for the continuous folding of sheet material into different three-dimensional patterns is disclosed.

In a general overview, the inventive machine causes the material to funnel towards an end section, which imparts the final folds or pattern. The funnel process can be thought of as a method of force convergence, or continuous-positioning of the material towards the final stage of the machine. The material is then finally folded in the desired pattern at the final stage.

The invention accomplishes all these functions by having both a unique structure and unique programming. The programming allows for the change of the folding sequence, so that different patterns can be produced. The programming also allows for a change of material and a change of material size. The programming is the subject of a U.S. Pat. No. 6,935,997, issued on Aug. 30, 2005, the teachings of which are incorporated herein by way of reference to the extent they do not conflict herewith.

The innovative machine folds sheet material, including paper, biodegradable material, composites and plastics, enables a flat sheet of material to be fed through a series of rollers or dies (the number of which is a function of final product width) that pre-fold the material until it reaches the last set of rollers or dies. Note that in a preferred embodiment, the rollers are heated to allow plastic material to be folded. The final fold pattern is implemented by having the pattern geometry negatively engraved on these rollers. The direction of the engraved folding pattern on the last set of rollers can be made longitudinal or perpendicular to the roller axis (or at any desirable angle in between), resulting in a longitudinal or cross-folded sheet. Further, the last set of rollers can be rubber on metal (one roller from rubber and the other from metal to create sharp creases in the folded pattern.

The material is fed between the first set of rollers or dies, which makes a central single fold in the middle of the material. The material then advances to a second set of rollers or dies, that makes two extra outer folds, one on each side of the first fold. The material then advances to a third set of rollers or dies, making two additional outer folds. This process continues at the sequenced sets of rollers or dies until the desired number of folds in the rolling direction is reached.

At the last set of rollers or dies, the material is rolled between two rollers or dies having cross fold or same directional fold patterns engraved/machined on their surfaces to produce the final pattern. No additional folds are made at the last set of rollers or dies. The design, manufacture, and integration of the last set of rollers or dies is flexible enough that other patterns can easily be produced in a short period of time and with minimum machine setting of both pre- and final folding stages. The above procedures are applicable to any other method for folding based on the principle of series 1, 3, 5, 7, . . . . This includes flat dies or frames with grooves that follow this sequence.

The folded sheet, upon leaving the inventive machine, can be compressed further to any desired compaction ratio and/or laminated to produce structures and packaging material with specific characteristics. The design flexibility of the machine allows folding patterns of different materials and different thicknesses and/or with different mechanical properties.

Specifically, the invention performs folding in the mathematical series 1, 3, 5, 7, . . . , where the numerals are related to the number of tessellations on the surface of each set of rollers or dies at each stage of the initial folding process. This specific sequencing, creating two new longitudinal tessellations on each successive set of rollers according to the mathematical series 1, 3, 5, 7, . . . totally eliminates the typical material slitting phenomenon, which occurs if all tessellation is performed in one set of rollers or dies, causing material to be cogged in, and stretch to conform to, roll or die profile. This innovative technique eliminates this slitting phenomena by subjecting the sheet material to only two predetermined transverse friction forces: one on each edge of the sheet. Material on the edges have access to flow in from the sides to form the next two extra tessellations without undue restriction.

The innovative sequential tessellation technique enables sheet materials to be effectively folded with minimum power requirements, and without sheet slitting and/or stretching.

This technology introduces new and highly economical methods of producing lightweight cores, structures, and packages that outperform most of the existing comparative structures and their methods of production. The material that is formed has many applications ranging from the design of diesel filters, to aviator crash helmets, to high-speed lighters, to airdrop cushioning systems, to biodegradable packaging materials and to lightweight floor decks, among others. The technology can produce structures of versatile shapes, single and multiple layers, and different patterns created from different materials, geometries and dimensions.

The inventive machine has produced packages that have outperformed prior honeycomb packages, the current industry and government standard. The produced cushioning packaging pads are capable of absorbing significantly higher energy per unit volume when compared with honeycomb packaging structures.

All types of 3-D geometrical patterns can be formed from a flat sheet of material without stretching, and then selecting such a pattern to be folded. Specifically, to preserve the folding intrinsic geometry, each vertex in a faceted surface must have all the angles meet at the point from adjacent faces to total 360 degrees. This 360-degree total of angles is required for the vertex to unfold and lay flat in the plane, thereby eliminating stretching.

A mathematical theory of the folding geometry of this invention can be studied in greater detail in U.S. Pat. No. 6,935,997. This theory facilitates the pattern selection process for use with the inventive machine. A pattern can be chosen via this mathematical theory based on different criteria, such as geometry, strength, or density, based on the desired parameters of the final product.

Other existing technologies for folding sheet materials are not at all similar to the inventive technology. For example, the above-referenced PATERSON patent consists of flat and rigid tessellations that are identical to those of the pattern to be produced in the final folded shape. This technology and other types of technologies result in non-uniform changes in both sheet thickness and material properties, due to the nature of the forming operation. This is opposed to the current invention's folding operation that does not stretch or adversely change any of the existing material physical or mechanical properties.

An advantage of the present invention is its ability to fold sheet material into a continuous intricate faceted structure.

Another advantage of the present invention is that it is a versatile, flexible, and inexpensive machine that performs various folding operations.

Another advantage of the present invention is its ability to fold sheet material while preserving its intrinsic geometry without stretching it.

Another advantage of the present invention is its ability to fold sheet material with minimum energy and load requirement, due to the nature of the folding mechanism being of very localized deformed zones of plastic hinges formed on tessellation edges.

Another advantage of the present invention is its ability to fold sheet material into a mating surfaces pattern such as a honeycomb structure, for example.

Another advantage of the present invention is its ability to fold sheet material into patterns having folded structures with heights of less than 0.25 inch.

Another advantage of the present invention is its ability to fold sheet material into a double sided inclined folded core structure.

Another advantage of the present invention is its ability to split a double sided inclined folded core structured material into two singular inclined direction folded and core structured strips of material.

BRIEF DESCRIPTION OF THE DRAWINGS

The present invention is described in detail below with reference to the accompanying drawings, in which like items are identified by the same reference designation, wherein.

DESCRIPTION OF THE PREFERRED EMBODIMENT

Generally speaking, the present invention is a machine for continuous folding of sheet materials. The machine comprises a plurality of rollers or dies, each with a different amount of raised portions (related to the number of tessellations) for creating folds in the material traveling through the machine.

Figure 1:
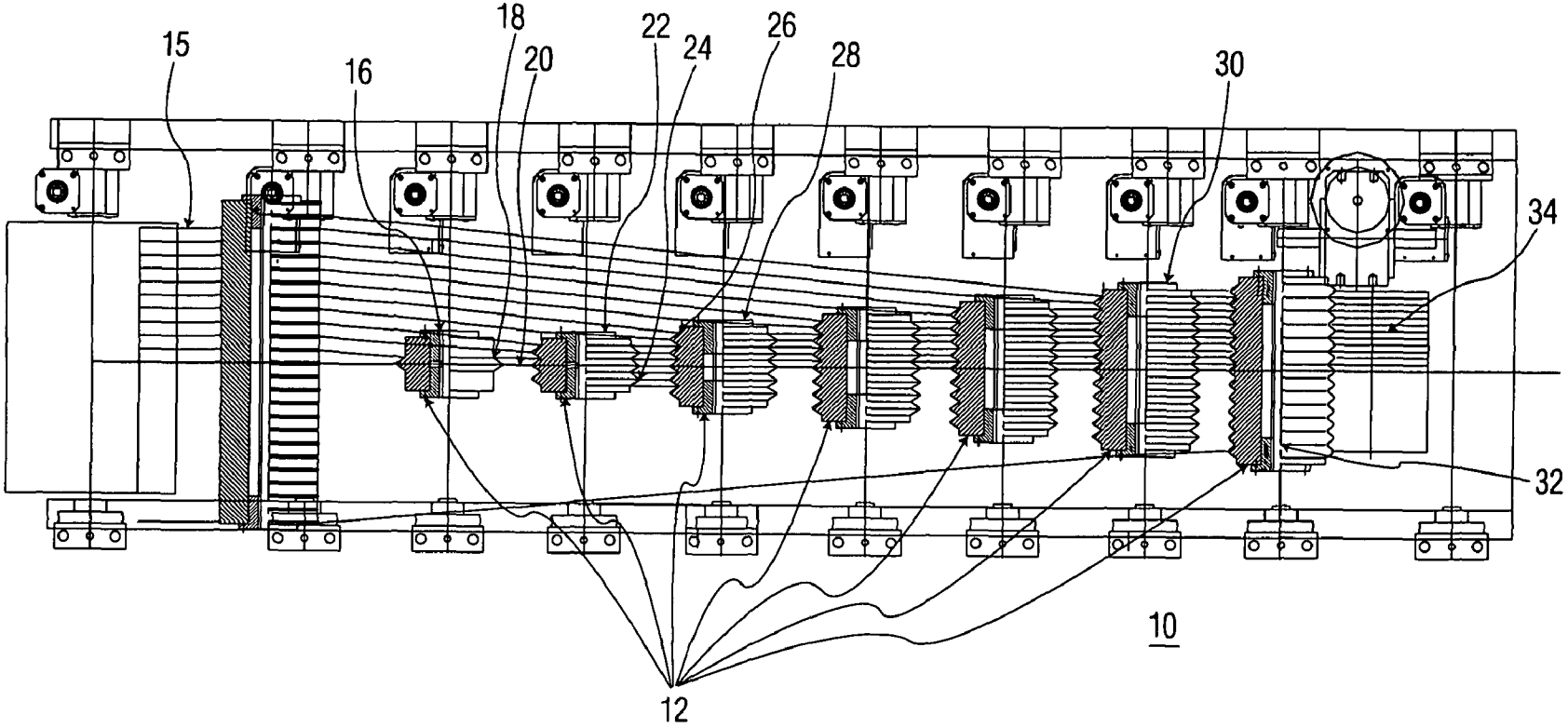
FIG. 1 illustrates a top plan view of the machine of this invention for continuous folding of sheet materials.

With reference to FIG. 1, the machine for continuous folding of this invention is generally referred to as number 10. As shown, the machine for continuous folding 10 comprises a plurality of sets of rollers or dies 12. A set of rollers 12 comprises upper rollers and lower rollers, shown in FIG. 2. Each set of rollers or dies 12 has a number of tessellations 18 for folding sheet material 15, also shown in FIG. 3, where each tessellation 18 is a series of raised shapes that span the circumference of the roller. As described and shown below in certain embodiments of the invention, the tessellation(s) 18 are "V" shaped, whereas in other embodiments they appear as a series of successive cleat-like protrusions from each associated roller of a last set of rollers.

The sheet material 15 is fed through the first proximal set of rollers or dies 16. Each roller or die 13, 14 of the first proximal set of rollers or dies 16 has one tessellation 18. This tessellation 18 makes a single fold 20 in the sheet material 15.

Each roller or die 19, 21 of the second set of rollers or dies 22 has three tessellations for making an additional two folds in the sheet material 15. The single fold 20 produced by the first proximal set of rollers or dies 16 proceeds through the center tessellation of the second set of rollers or dies 22 where it maintains its shape. Two new folds 24, 26 are created by the outside tessellations of the second set of rollers or dies 22.

Each roller or die 23, 25 of the third set of rollers or dies 28 has five tessellations, two more tessellations 18 than each roller or die 19, 21 in the previous second set of rollers or dies 22. This pattern of two additional tessellations 18 per roller or die continues from the first set of rollers or dies 16 to the penultimate set of rollers or dies 40, 42, shown in this embodiment at numeral 30. Each roller or die 36, 38 of the final set of rollers or dies 32 (also shown as a close up in FIG. 4) has the same number of tessellations 18 as each roller or die 40, 42 of the penultimate set of rollers or dies 30. The final fold pattern 34 is implemented by having the pattern geometry negatively engraved on the last set of rollers or dies 32. Further, the last set of rollers or dies 32 can be made of rubber (when desired) to create sharp creases in the sheet material 15.

Seven sets of rollers or dies are depicted in FIG. 1, but the inventive machine for continuous folding 10 can have any number of sets of rollers or dies depending on the desired width of the final folded structure. The number of tessellations 18 on each roller or die is determined from the mathematical series 1, 3, 5, 7, . . . , where each roller or die 13, 14 in the first proximal set of rollers or dies 16 has one tessellation 18, and each roller or die 19, 21 in the second set of rollers or dies 22 has three tessellations 18, etc.

Should the user decide to use the special rubber rollers or dies, however, each of either roller or die 36, 38 in the last set of rollers or dies 32 has the same amount of tessellations 18 as each roller or die 40, 42 in the penultimate set of rollers or dies 30. The final material 34 is in the desired form once it leaves the last set of rollers or dies 32. To fold a different pattern on the sheet material 15, the tessellations 18 on all of the rollers or dies can be easily changed.

The design of the machine for continuous folding 10 allows any length of material to be folded. The sheet material 15 starts out at its widest width at the first set of rollers or dies 16 and becomes narrower at each successive set of rollers or dies, as the number of tessellations 18 increases (FIG. 1). This design allows for any length of material to be folded without incurring damage (e.g., stretching) to the sheet material 15.

Figure 4:
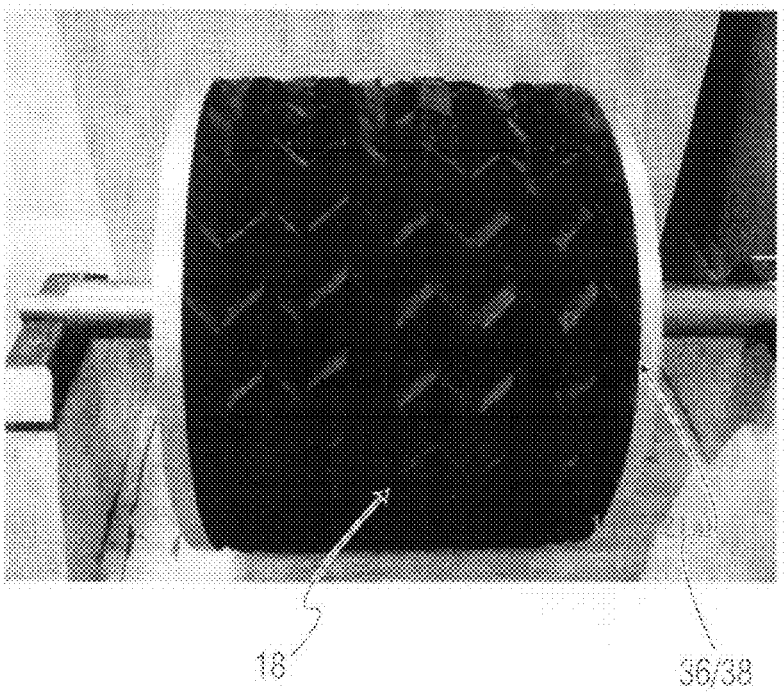
FIG. 4 illustrates a pictorial view of the last set of rollers of the machine for continuous folding of sheet materials into a Chevron pattern.
Figure 5:
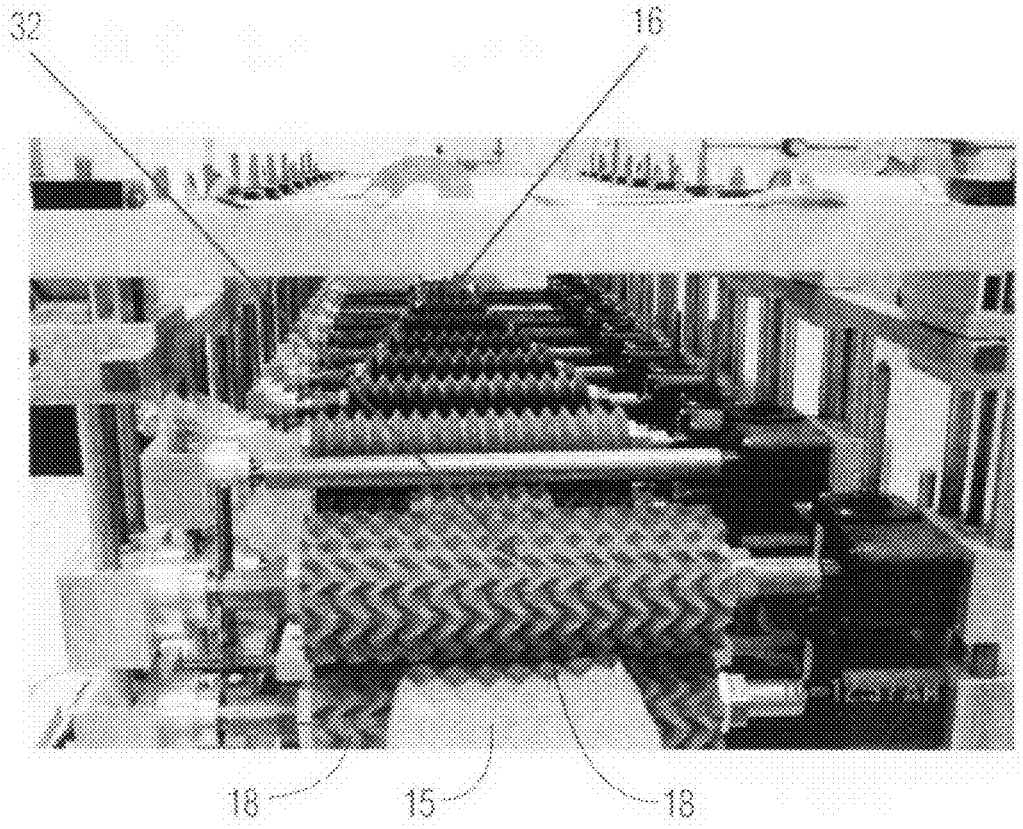
FIG. 5 is a back pictorial view of the machine configured for producing a mating surfaces (MS) pattern in sheet material.
Figure 6A:
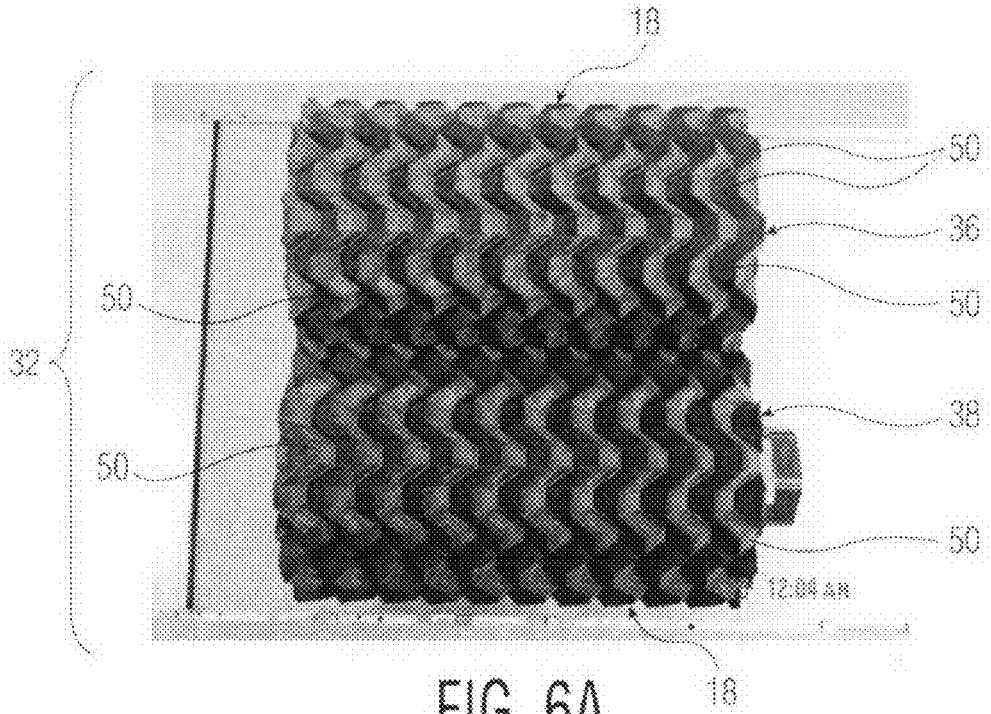
FIG. 6A is a front pictorial view of a set of rollers used for producing an MS pattern in sheet material.
Figure 6B:
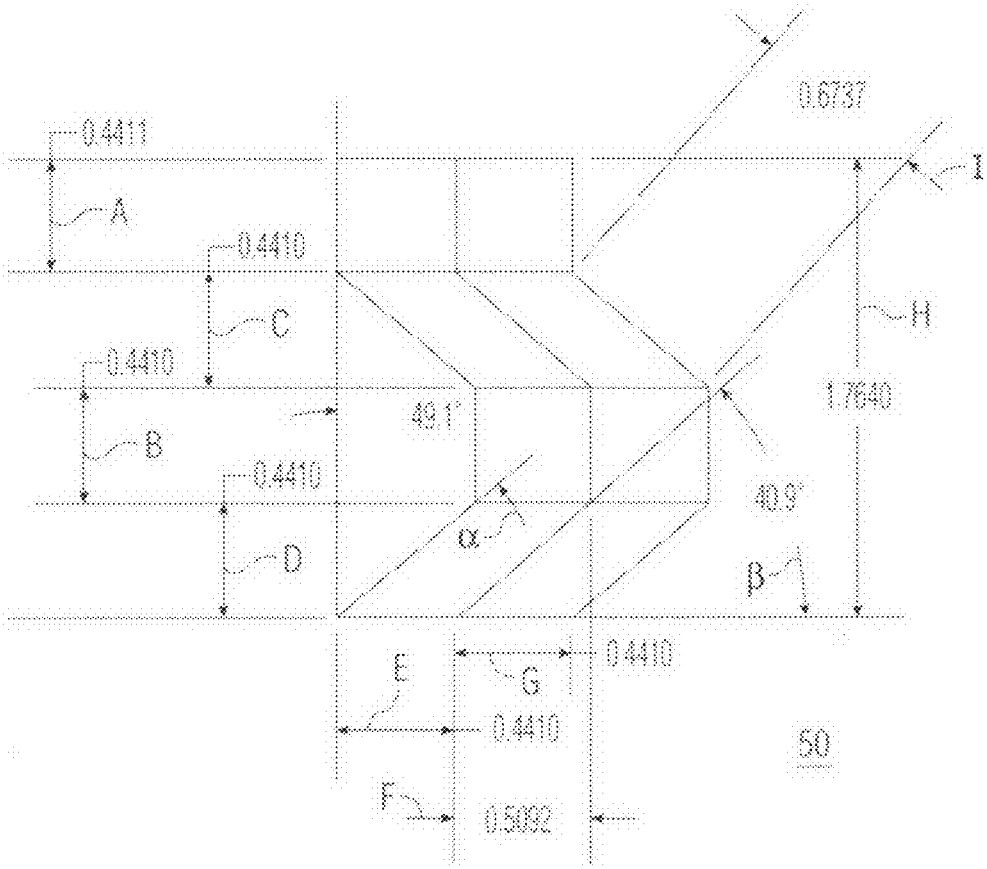
FIG. 6B is a pictorial view of the geometry of one cleat pattern engraved on the rollers of FIGS. 5 and 6A.
Figure 7:
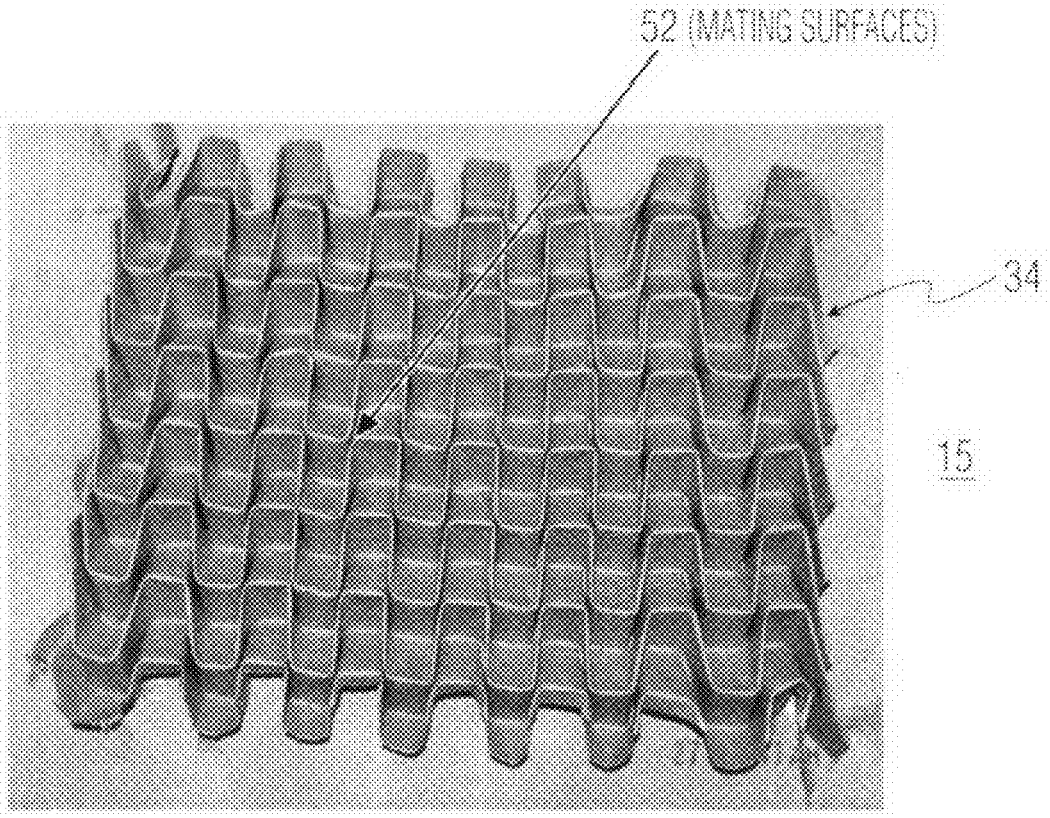
FIG. 7 is a pictorial view of a section of sheet material folded into an MS pattern with mating surfaces highlighted.

The previously described embodiments of the invention produce through use of the final set of rollers of dies 32, with each roller or die 36, 38 and tessellations 18 configured as shown in FIG. 4, a Chevron pattern in the final fold pattern 34 of the sheet material 15. As previously indicated, the present machine can be modified in other embodiments of the invention for producing a plurality of other patterns in the sheet material 15. For example, in another embodiment of the invention, the final or last set of rollers or dies 32 has tessellations 18 that are configured as shown in FIGS. 5, 6A, and 6B, to provide a mating surfaces pattern as opposed to the previously described Chevron pattern, for ultimately folding the sheet material 15 to have a final fold pattern 34, that is comparable to a honeycomb structure. For purposes of this description, this pattern is referred to as an MS pattern (Mating Surfaces Pattern) for a configuration of the tessellations 18. FIG. 5 shows the ultimate or left side of rollers or dies 32 of this MS pattern for the tessellations 18. FIG. 6A is a detailed view of the configuration of the tessellations 18 and the MS pattern for each of the associated rollers 36 and 38. The geometry of each of the cleat-like protrusions 50 of the MS pattern engraved on rollers 36, 38 is as shown in FIG. 6B. The dimensions of "A" through "I" are shown in FIG. 6B in inches for producing an MS pattern with a final fold pattern 34 of the sheet material 15, as shown in FIG. 7. Note that in FIG. 6B critical angles $\alpha$ and $\beta$ are shown, which in the preferred embodiment, must be retained regardless of a change in the dimensions "A" through "I." As indicated, the dimensions specifically shown in inches are in FIG. 6B are for producing 0.5 inch high MS pattern, which dimension can be smaller or larger by correspondingly changing the dimensions "A" through "I," but in the preferred embodiment retaining the ratio therebetween as indicated for the 0.5 inch high MS pattern. Note that proportional dimensions are obtained for MS patterns with different heights. Note that adhesives (not shown) can be applied between the mating surfaces 52 to provide a structure that maintains its shape without having any laminated surfaces.

Figure 2:
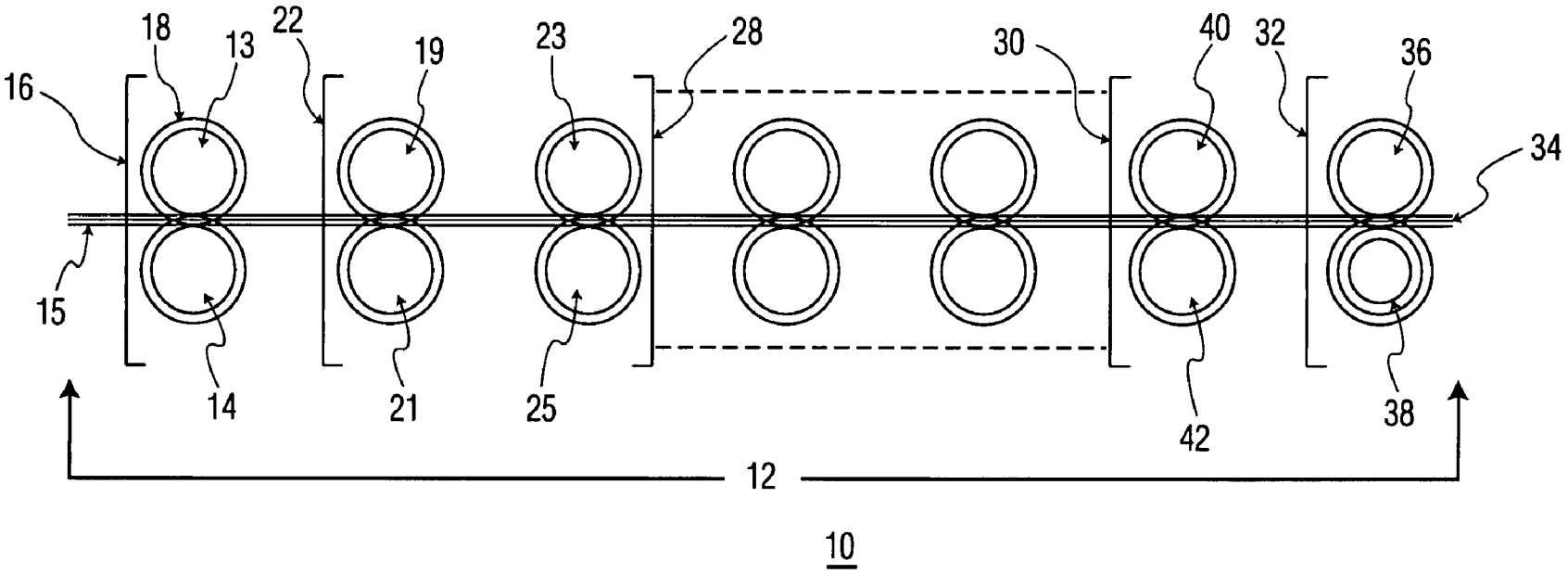
FIG. 2 illustrates a side elevational view of the machine for continuous folding of sheet materials.
Figure 3:
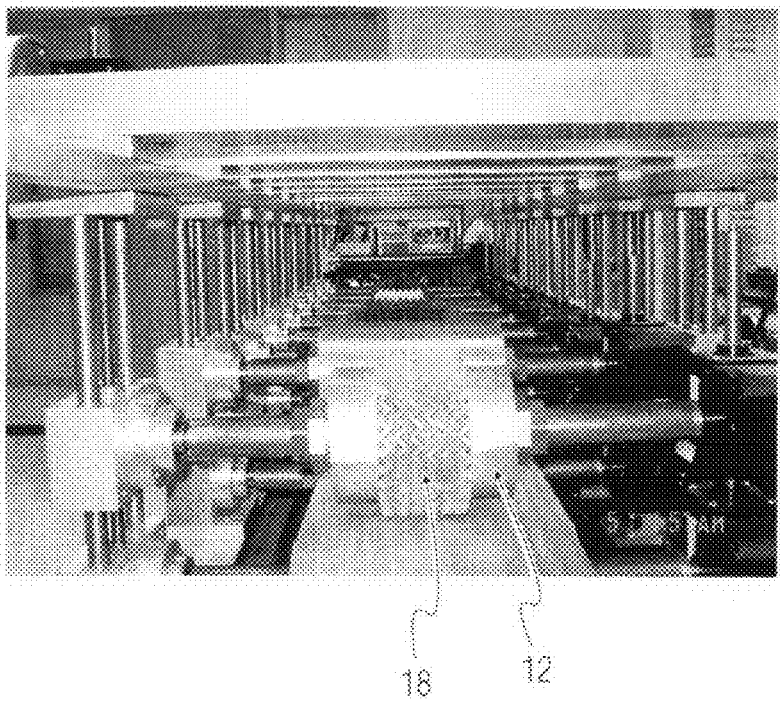
FIG. 3 illustrates a front pictorial view of the machine for continuous folding of sheet materials.
Figure 8:
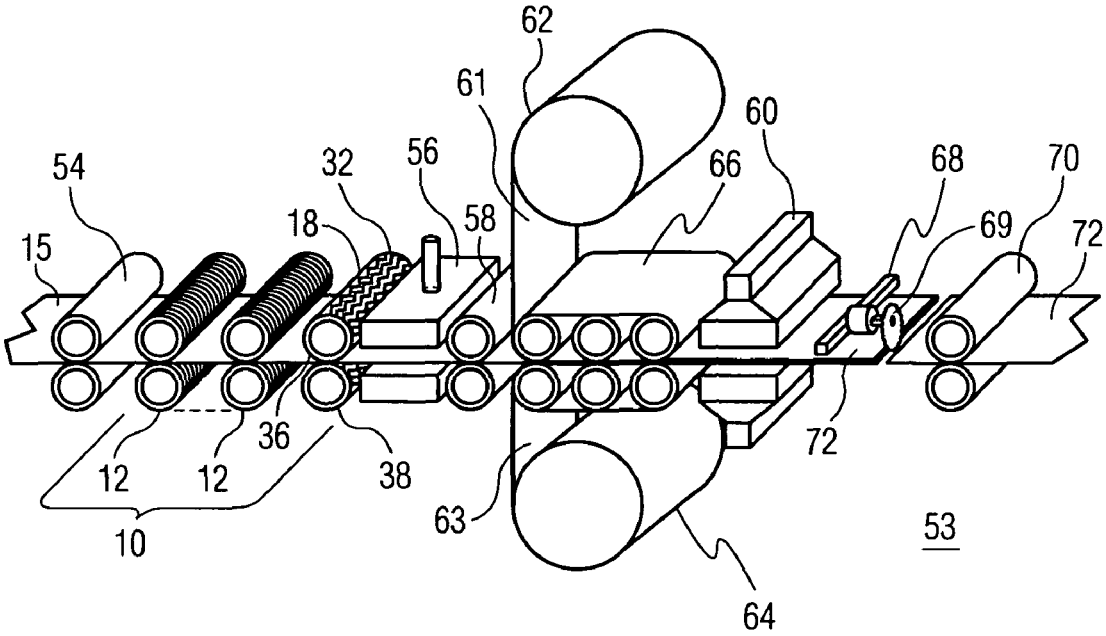
FIG. 8 is a pictorial view of a machine of an embodiment of the invention for producing a continuous MS pattern laminated structure.
Figure 9:
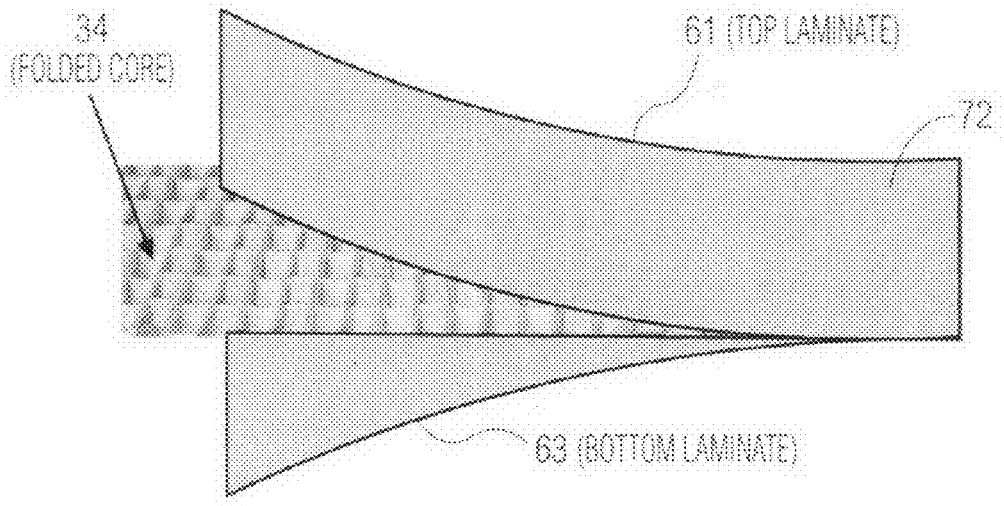
FIG. 9 is a detailed pictorial view showing top and bottom laminates of sheet material being secured to an MS patterned sheet of material.

In another embodiment of the invention, in addition to directly gluing or applying adhesives between mating surfaces 52 of the MS patterned sheet material 15 as shown in FIG. 7, the material can be laminated. More specifically, in another embodiment of the invention, the machine 10 of FIG. 2 is expanded as shown in FIG. 8, for automatically laminating the MS patterned sheet material 15. With further reference to FIG. 8, the sheet material 15 is fed to the expanded machine 53 from a supply roller (not shown), and fed into a set of core punching rollers 54, the purpose of which is to produce through holes similar to honeycomb (if this is desired). From the set of core punching rollers 54 the material 15 is fed into the plurality of sets of rollers or dies 12 previously described for the machine 10, with the last set of rollers or dies 12 being rollers 36 and 38 each having tessellations 18 configured as shown in FIG. 6A, as previously described. After the sheet material 15 exits from the MS configured rollers or dies 36, 38, adhesive is applied to specific areas of the core via an adhesive applicator system 56, with the material 15 proceeding to be compacted via a set of compacting rollers 58 surrounding the mated surfaces 52 of the MS folded pattern (see FIG. 7), to adhere to each other. The material 15 is then fed into a traction unit 66 on which the top laminated material 61 is fed from a supply roll 62, and bottom laminated material 63 is fed from a supply roll 64, as shown. Laminated material 72 so produced is then fed through an adhesive curing system 60, and pulled through the system by a pair of traction rollers 70. The desired lengths of the laminated material 72 are cut by a flying cutter 69 located between the adhesive curing system 60 and the traction rollers 70, in this example. Other traction rollers (not shown) move the finished and cut laminated product to a delivery area. The pictorial diagram of the MS patterned folded core material 34 as it is being laminated with a top laminate 61 and bottom laminate 63 is shown in FIG. 7. Note that the sheet material 15 can be a different material than the laminate material 61 and laminate material 63, which themselves can be different materials. Also, as previously indicated, the folded core material 34 can be produced in different configurations for providing patterns of different heights and cell sizes, dependent upon the application, for changing the pattern on the final set of rollers 32, as previously described. Also, the core punching rollers 54 can be disabled for turning off the punching system to provide for the core structures 34 without holes, if desired. The laminate material 61 and 63 can be paper, fiberboard, plastic material, and so forth.

Figure 10:
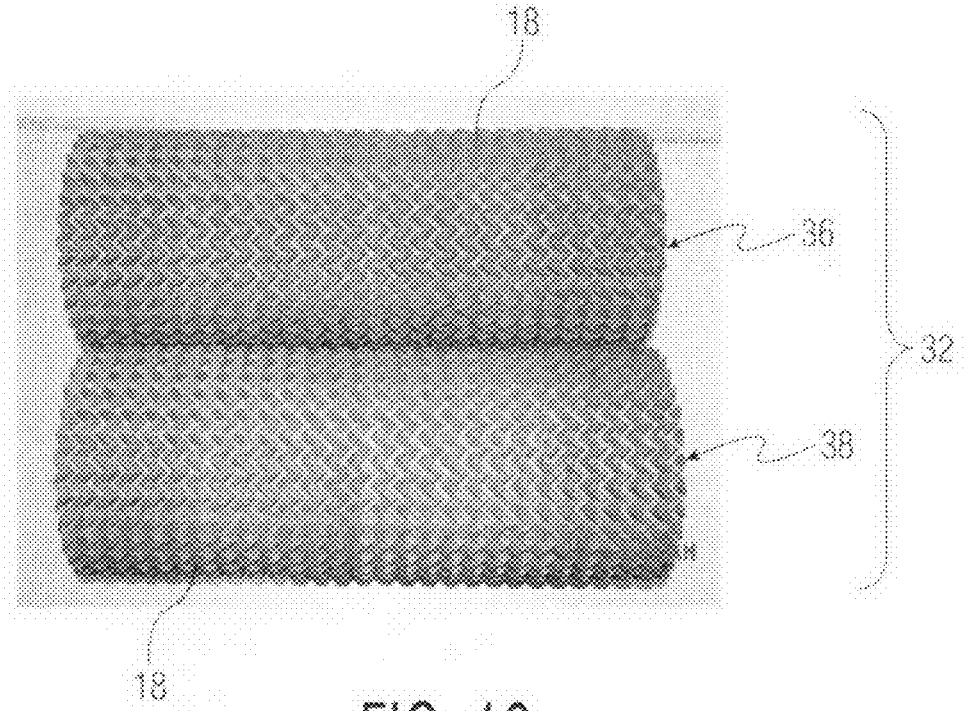
FIG. 10 is a front pictorial view of an engraved set of final rollers for producing a folded core having a height of 0.25 inch in sheet material, for another embodiment of the invention.
Figure 11A:
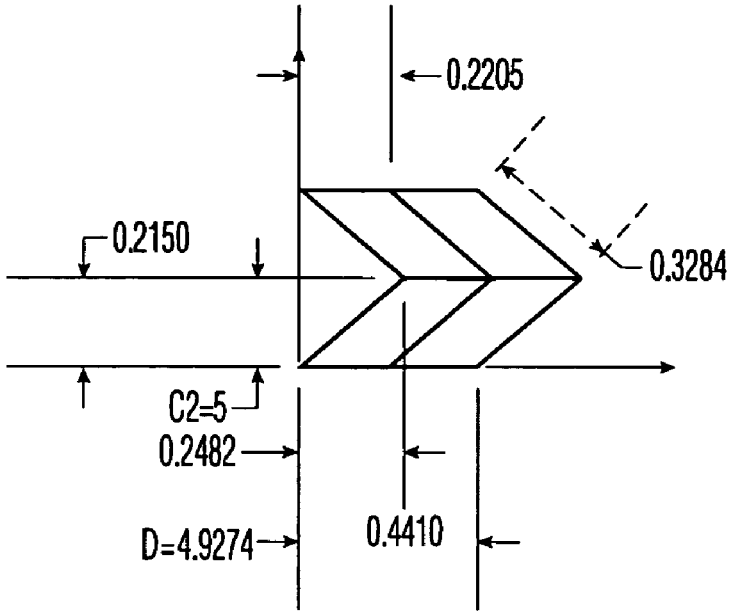
FIGS. 11A and 11B are respective pictorial views showing the geometry of the cleats of the set of rollers of FIG. 10.
Figure 11B:
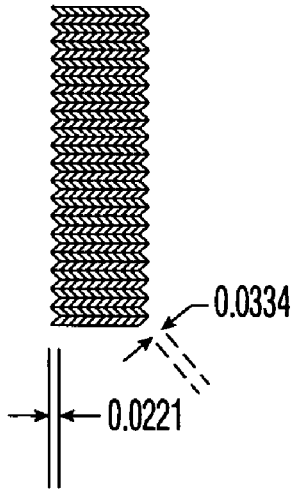
Figure 13:
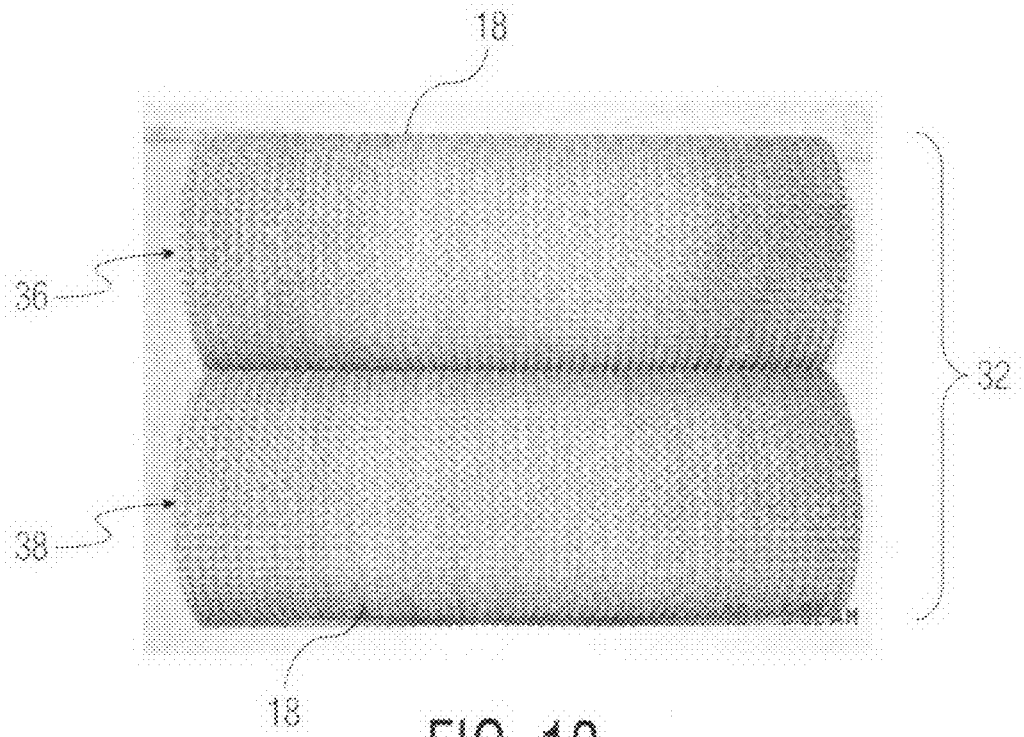
FIG. 13 is a front pictorial view of an engraved set of final rollers for producing a folded core having a height of 0.125 inch in sheet material, for another embodiment of the invention.
Figure 14A:
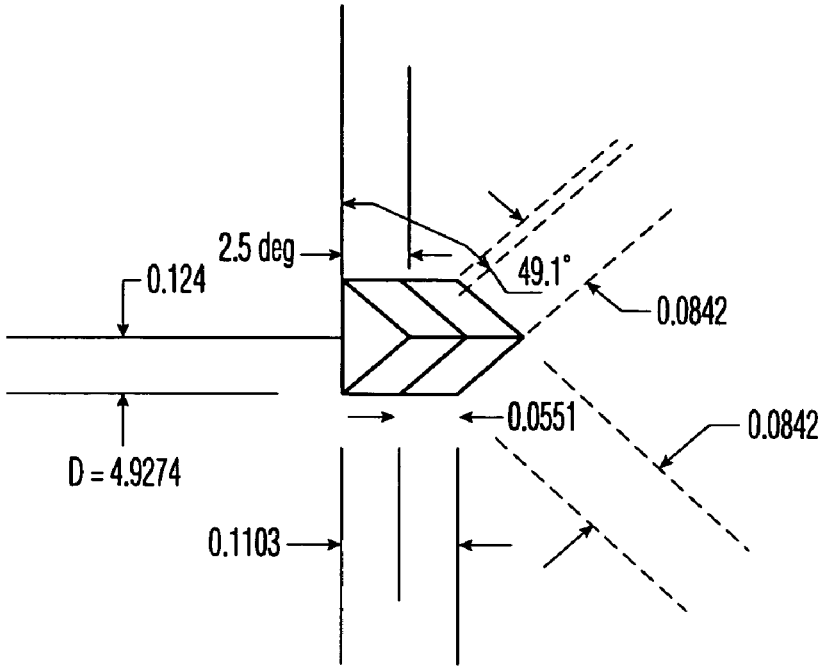
FIGS. 14A and 14B are respective pictorial views showing the geometry of the cleats of the set of rollers of FIG. 13
Figure 14B:
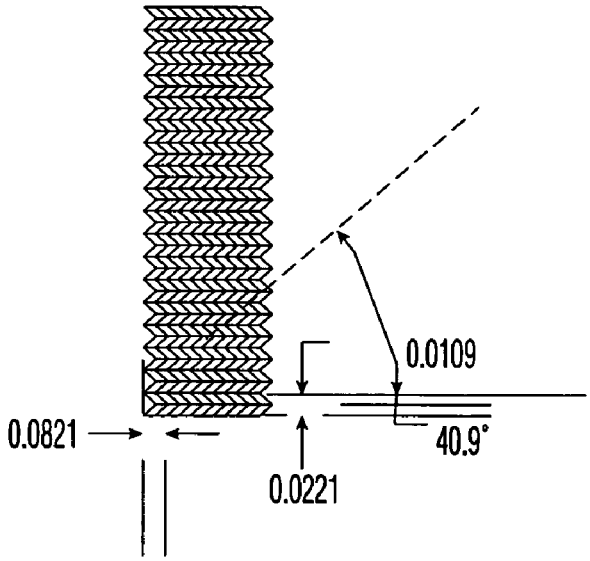

As previously indicated, core structures having heights of less than 0.5 inch can be provided by a changing the configuration of the tessellations 18 of the last set of rollers 32, as previously described. For example, the final roller set 32 shown in FIG. 10 has a pattern engraved on the rollers 36 and 38 for producing a folded core in sheet material 15 having a height of 0.25 inch. The geometry for the pattern engraved on the rollers 36 and 38, in this example is shown in FIGS. 11A and 11B. To provide a vertical core pattern 34 of 0.25 inch high for the final set of rollers 32, the individual rollers 36 and 38 thereof are engraved with the pattern shown in FIG. 13. The geometry for this latter pattern is shown in FIGS. 14A, and 14B. However, the geometries of the final set of rollers 32 for the engraved pattern for each of the associated rollers 36 and 38, can be other than as provided in the previous examples for obtaining vertical core patterns 34 in the sheet material 15 having some other predetermined or desired height than illustrated above.

Figure 12:
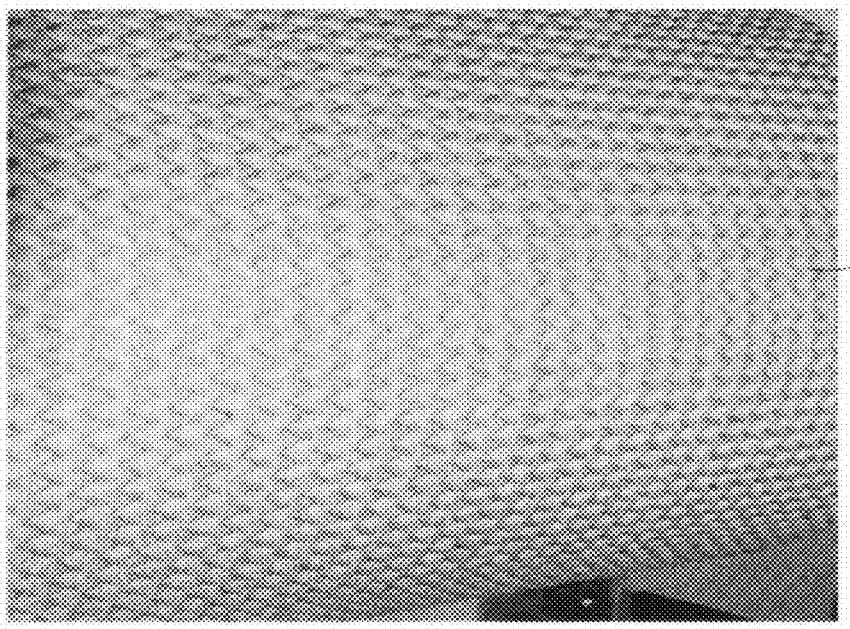
FIG. 12 is a pictorial view of a portion of sheet material folded via use of the rollers of FIG. 10.
Figure 15:
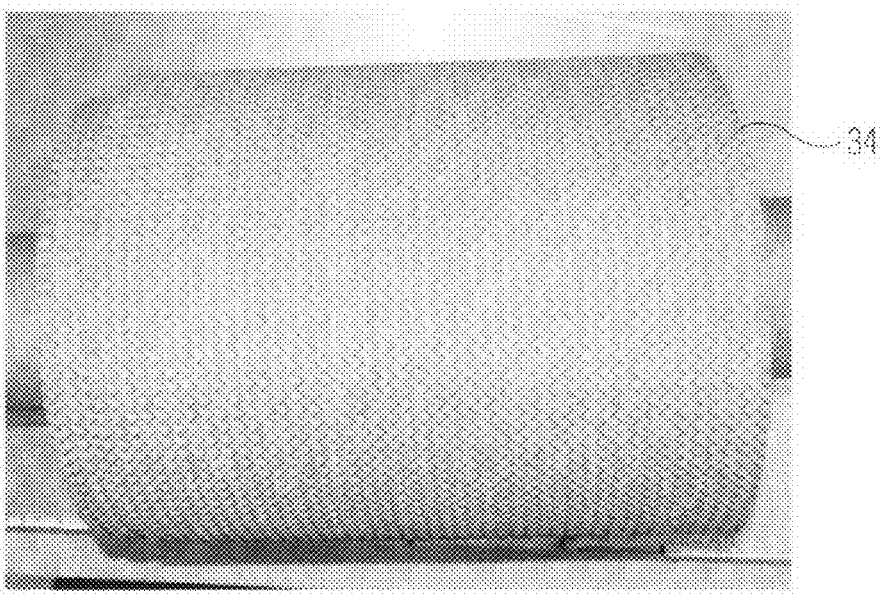
FIG. 15 is a pictorial view of a portion of sheet material folded via use of the rollers of FIG. 13.

FIG. 12 shows the resultant folded core material having a height of 0.25 inch, for the example given above. A comparison thereto, FIG. 15 shows the final fold pattern 34 having a folded core of 0.125 inch, produced as indicated above. The production of final fold pattern 34 of sheet material 15 provides a high stiffness-to-weight ratio of roller core tubes with a built-in partitioning surface. For example, the final fold patterns 34 of FIGS. 12 and 15 are suitable for roll cores of metallic foils, and eliminate core detaching problems as found in the prior art.

Figure 16:
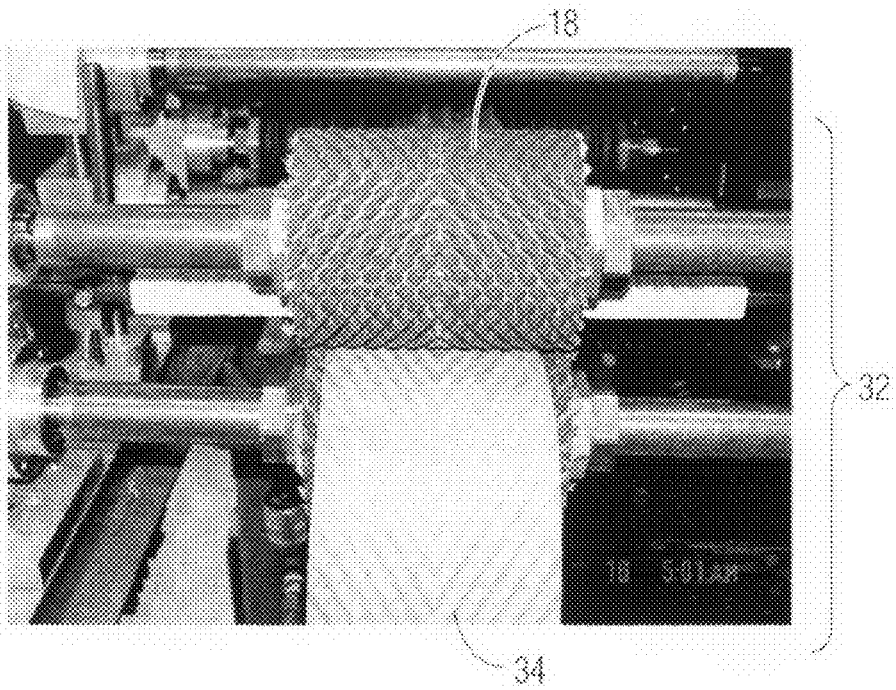
FIG. 16 is a front pictorial view of a set of final folding rollers for producing a double-sided inclined folded core structure or pattern in a sheet of material, for another embodiment of the invention.
Figure 17A:
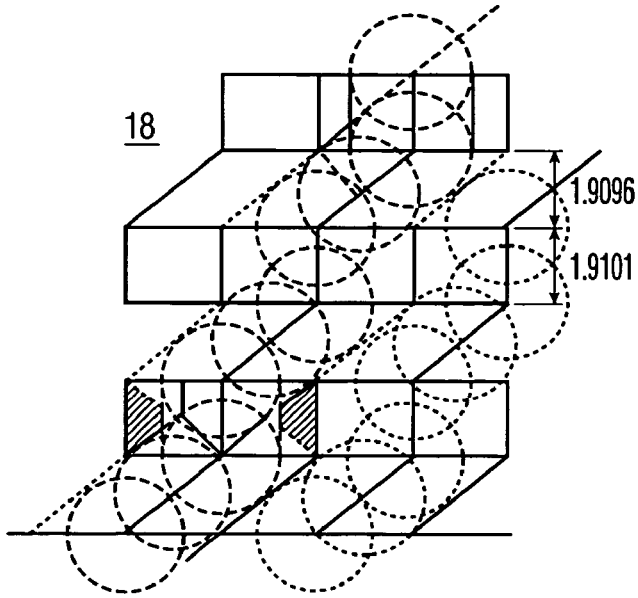
FIGS. 17A and 17B are respective pictorial views showing the geometry of the cleats of the set of rollers of FIG. 16.
Figure 17B:
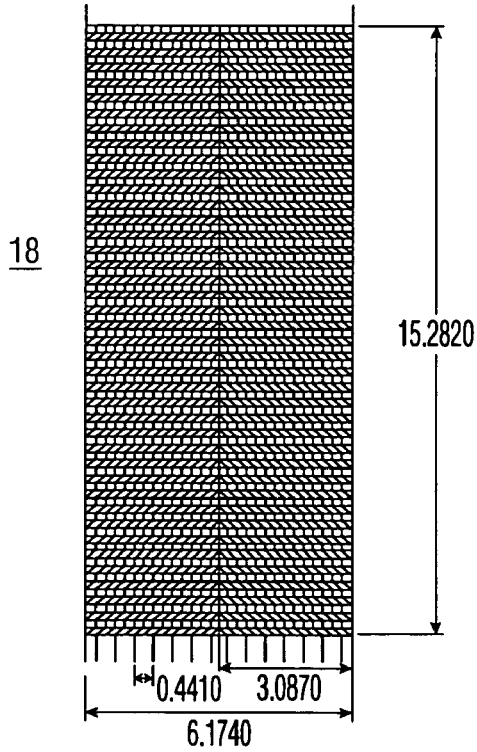

In another embodiment of the invention an angular oriented folded core structure pattern is produced in a sheet material 15, for providing a fold direction progressing at a predetermined angle to a longitudinal direction of rolling. To accomplish this, the present inventors had to overcome folding forces that generate a tangential component, which causes continuous shifting of the incoming sheet material 15 in the direction of inclination, that heretofore made it impossible to maintain the sheet material 15 within the rollers of machines of the prior art. The present inventors discovered that via the use of a double helix-like pattern in the rollers, the side force effect was eliminated. The final set of rollers 32 have tessellations 18 provided in the double helix pattern shown in FIG. 16. The final fold core structure 34 is a double-sided inclined structure, as shown. The geometry for the tessellations 18 for providing the doubled-sided inclined folded core structure 34 is shown in FIGS. 17A and 17B.

Figure 18:
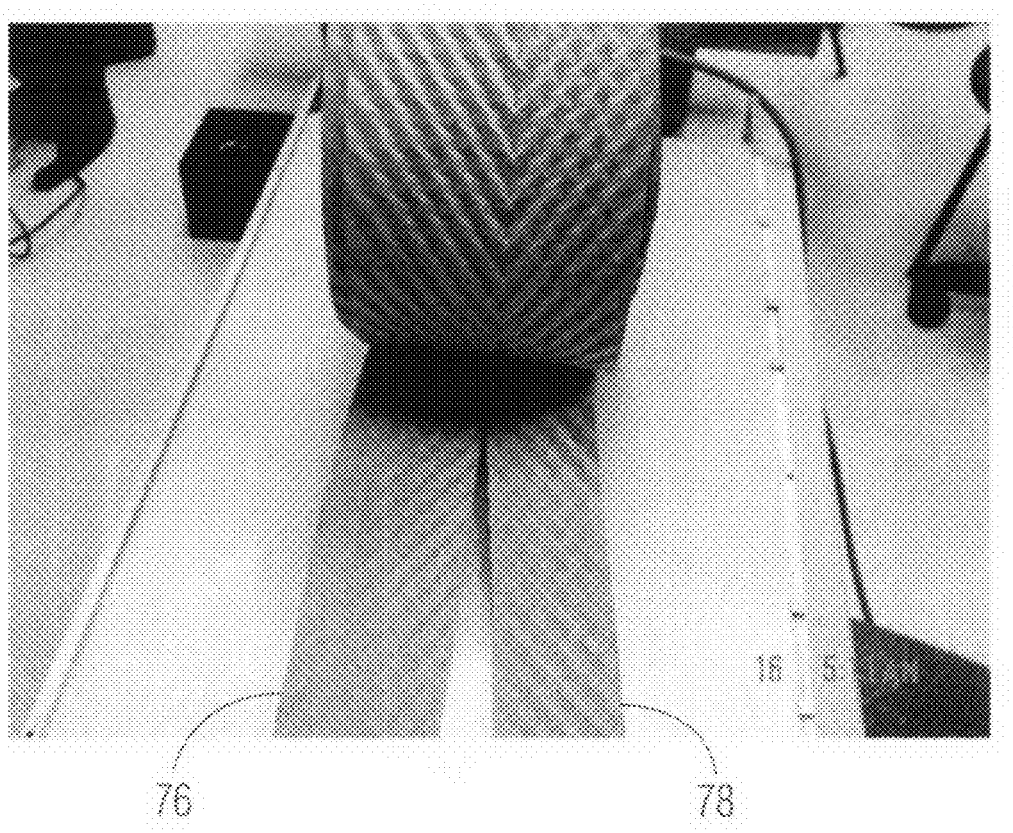
FIG. 18 is a pictorial view showing the process of splitting the double sided inclined folded core structure of the sheet material into two sheets or strips of singular inclined direction folded core structured material.

The double-sided inclined folded core structure 34 can be split as shown in FIG. 18. The splitting process provides two singular inclined direction folded core structures 76, 78, respectively, as shown in FIG. 18.

Since other modifications and changes varied to fit particular operating requirements and environments will be apparent to those skilled in the art, the invention is not considered limited to the examples chosen for purposes of disclosure and covers all changes and modifications which do not constitute departures from the true spirit and scope of this invention. Any such modifications and changes are meant to be covered by the spirit and scope of the appended claims.

What is claimed is:

1. A method for continuously folding sheet material into a desired pattern comprising the steps of:

successively folding said sheet material, beginning at the central longitudinal axis thereof, into an increasing number of longitudinal folds following the mathematical series 1, 3, 5, 7 . . . , respectively, to insure the correct positioning of said sheet material throughout the folding operation;

applying a folding pattern into said successively folded sheet material, for finally folding said sheet material to have a predetermined pattern, said final folding pattern having folds at an angle to said longitudinal folds and successively juxtaposed elements equal in number to the number of longitudinal folds in said sheet material as a result of said successively folding step;

configuring the folding pattern to produce a double-sided inclined folded core structure having folds in the form of opposing helices at an angle to one another in said sheet material; and splitting said double-sided inclined folded core structure sheet material into two independent singular inclined direction folded core sheet material, respectively.

2. A method for continuously folding sheet material into a desired pattern comprising the steps of:

successively folding said sheet material, beginning at the central longitudinal axis thereof, into an increasing number of longitudinal folds following the mathematical series 1, 3, 5, 7 . . . , respectively, to insure the correct positioning of said sheet material throughout the folding operation, wherein the increasing number of longitudinal folds follows the non-repetitive mathematical series 1, 3, 5, 7, . . . , respectively, with no one member of the series being repeated;

applying a folding pattern into said successively folded sheet material, for finally folding said sheet material to have a predetermined pattern, said final folding pattern having folds at an angle to said longitudinal folds and successively juxtaposed elements equal in number to the number of longitudinal folds in said sheet material as a result of said successively folding step; and configuring the folding pattern to produce a double-sided inclined folded core structure having folds in the form of opposing helices at an angle to one another in said sheet material.

3. A machine for continuously folding sheet material into a honeycomb configuration, said machine comprising:

a plurality of successive first sets of rollers each including first and second opposing rollers between which said sheet material is passed, said first and second rollers each including an equal number of longitudinal tessellations about their respective circumferences, the first through penultimate sets of said plurality of successive sets of rollers successively folding said sheet material into an increasing number of longitudinal folds following the mathematical series 1, 3, 5, 7 . . . , respectively, the numerals of the latter also corresponding to the number of tessellations on each of said first and second rollers from the first to the last set of rollers, respectively, of said plurality of first successive sets of rollers, thereby maintaining the correct positioning of said sheet material during the folding thereof;

said first through penultimate sets of said plurality of successive sets of rollers being non-repetitive relative to the number of longitudinal tessellations;

a second set of first and second opposing rollers each having the same number of tessellations as the last first set of rollers of said plurality of successive first sets of rollers, each roller of said second set of rollers having a pattern geometry that is the negative of a predetermined pattern for final folding said sheet material passing therethrough to yield the desired pattern including folds at an angle to said longitudinal folds, whereby a cross-folded sheet of said sheet material is produced; and said first and second rollers of said second set of rollers each having a pattern for final folding said sheet material into folds providing a plurality of mating surfaces structure approaching a honeycomb configuration.

4. The machine of claim 3, further including means for securing together the plurality of mating surfaces to maintain the shape of the final folded sheet material.

5. The machine of claim 3, further including means for laminating said final folded sheet material between a top laminate material and a bottom laminate material.

6. The machine of claim 5, wherein said laminating means include:

an adhesive applicator for receiving the finally folded sheet material and applying adhesive to top and bottom portions thereof;

means for receiving said sheet material from said adhesive applicator for applying laminate material to top and bottom portions of said sheet material; and an adhesive curing system for curing the adhesive of the laminated finally folded sheet material.

7. The machine of claim 6, wherein said laminating means further includes:

means for cutting the laminated finally folded sheet material into desired lengths.

8. The machine of claim 7, wherein said laminating means further includes a pair of traction rollers for receiving cut pieces of the laminated sheet material for moving the same to a delivery area.

9. The machine of claim 3, wherein said second set of first and second opposing rollers are provided with a pattern for producing a folded core having a predetermined height in said sheet material.

10. A method for continuously folding sheet material into a honeycomb configuration, comprising the steps of:

successively folding said sheet material, beginning at the central longitudinal axis thereof, into an increasing number of longitudinal folds following the mathematical series 1, 3, 5, 7 . . . , respectively, to insure the correct positioning of said sheet material throughout the folding operation;

said increasing number of longitudinal folds following the non-repetitive mathematical series 1, 3, 5, 7 . . . , respectively, with no one member of the series being repeated; and applying a folding pattern into said successively folded sheet material, for finally folding said sheet material to have a predetermined pattern, said final folding pattern having folds at an angle to said longitudinal folds and successively juxtaposed elements equal in number to the number of longitudinal folds in said sheet material as a result of said successively folding step and said final folding pattern having a plurality of mating surfaces structure approaching a honeycomb configuration.

11. The method of claim 10, further including the step of:

applying adhesive between the plurality of mating surfaces to maintain the shape of the final folded sheet material.

12. The method of claim 10, further including the step of laminating said finally folded sheet material between two strips of laminate material.

13. The method of claim 12, wherein said step of laminating further includes the steps of:

applying adhesive to top and bottom portions of said finally folded sheet material;

applying laminate material to the top and bottom portions of said finally folded sheet material; and curing the adhesive in the laminated finally folded sheet material.

14. The method of claim 13, further including the step of cutting the laminated finally folded sheet material into desired lengths.

15. The method of claim 10, wherein said applying step further includes the step of configuring the folding pattern to produce a folded core having a predetermined height in said sheet material.

16. A machine for continuously folding sheet material into a desired pattern, said machine comprising:

a plurality of successive first sets of rollers each including first and second opposing rollers between which said sheet material is passed, said first and second rollers each including an equal number of longitudinal tessellations about their respective circumferences, the first through penultimate sets of said plurality of successive sets of rollers successively folding said sheet material into an increasing number of longitudinal folds following the mathematical series 1, 3, 5, 7 . . . , respectively, the numerals of the latter also corresponding to the number of tessellations on each of said first and second rollers from the first to the last set of rollers, respectively, of said plurality of first successive sets of rollers, thereby maintaining the correct positioning of said sheet material during the folding thereof;

said first through penultimate sets of said plurality of successive sets of rollers being non-repetitive relative to the number of longitudinal tessellations;

a second set of first and second opposing rollers each having the same number of tessellations as the last first set of rollers of said plurality of successive first sets of rollers, each roller of said second set of rollers having a pattern geometry that is the negative of a predetermined pattern for final folding said sheet material passing therethrough to yield the desired pattern including folds at an angle to said longitudinal folds, whereby a cross-folded sheet of said sheet material is produced; and said second set of first and second opposing rollers being provided with a pattern geometry in the form of opposing helices each disposed at an angle to one another on opposing half-width portions of each roller to produce a double-sided inclined folded core structure in said sheet material.

17. A machine for continuously folding sheet material into a desired pattern, said machine comprising:

a plurality of successive first sets of rollers each including first and second opposing rollers between which said sheet material is passed, said first and second rollers each including an equal number of longitudinal tessellations about their respective circumferences, the first through penultimate sets of said plurality of successive sets of rollers successively folding said sheet material into an increasing number of longitudinal folds following the mathematical series 1, 3, 5, 7 . . . , respectively, the numerals of the latter also corresponding to the number of tessellations on each of said first and second rollers from the first to the last set of rollers, respectively, of said plurality of first successive sets of rollers, thereby maintaining the correct positioning of said sheet material during the folding thereof;

a second set of first and second opposing rollers each having the same number of tessellations as the last first set of rollers of said plurality of successive first sets of rollers, each roller of said second set of rollers having a pattern geometry that is the negative of a predetermined pattern for final folding said sheet material passing therethrough to yield the desired pattern including folds at an angle to said longitudinal folds, whereby a cross-folded sheet of said sheet material is produced;

said second set of first and second opposing rollers being provided with a pattern geometry in the form of opposing helices each disposed at an angle to one another on opposing half-width portions of each roller to produce a double-sided inclined folded core structure in said sheet material; and means for splitting said double-sided inclined folded core structured sheet material into two independent strips of singular inclined direction folded core structure sheet material, respectively.

* * * * *